US010161126B2

(12) United States Patent
Steiner et al.

(10) Patent No.: US 10,161,126 B2
(45) Date of Patent: Dec. 25, 2018

(54) PANEL WITH DEFINED FASTENER LOCATION

(71) Applicant: KETER PLASTIC LTD., Herzeliya (IL)

(72) Inventors: Yigal Steiner, Kibbutz Megiddo (IL); Avi Askof, Tzur Igal (IL)

(73) Assignee: KETER PLASTIC LTD., Herzelyia (IL)

( * ) Notice: Subject to any disclaimer, the term of this patent is extended or adjusted under 35 U.S.C. 154(b) by 0 days.

(21) Appl. No.: 14/915,719

(22) PCT Filed: Sep. 3, 2014

(86) PCT No.: PCT/IL2014/050792

§ 371 (c)(1),
(2) Date: Mar. 1, 2016

(87) PCT Pub. No.: WO2015/033342

PCT Pub. Date: Mar. 12, 2015

(65) Prior Publication Data

US 2016/0215493 A1 Jul. 28, 2016

Related U.S. Application Data

(60) Provisional application No. 61/873,028, filed on Sep. 3, 2013.

(51) Int. Cl.
*E04B 1/343* (2006.01)
*E04C 2/20* (2006.01)
(Continued)

(52) U.S. Cl.
CPC ..... *E04B 1/34321* (2013.01); *E04B 1/34384* (2013.01); *E04C 2/20* (2013.01);
(Continued)

(58) Field of Classification Search
CPC .... E04B 1/34348; E04B 1/34321; E04C 2/20; E04C 2/34; E04C 2/38; E04C 2/40; E04C 2/50; E04F 21/00
See application file for complete search history.

(56) References Cited

U.S. PATENT DOCUMENTS 1,664,464 A 4/1928 Purchas
D111,534 S 9/1938 Duncan
(Continued)

FOREIGN PATENT DOCUMENTS

DE 4237912 A1 5/1994
EP 1398429 A1 3/2004
GB 1065579 A * 4/1967 ..... E04C 2/40

OTHER PUBLICATIONS

International Search Report and Written Opinion issued in a corresponding application PCT/IL2014/050792 dated May 26, 2015.

*Primary Examiner* — Babajide A Demuren
(74) *Attorney, Agent, or Firm* — Dorsey & Whitney LLP

(57) ABSTRACT

The disclosed subject matter pertains to an artificial panel including a spaced apart first wall and second wall. Each of the walls has an inside surface and an outside surface, and at least one fastener location configured at an outside surface of the at least one of the first wall and the second wall of the panel. The fastener location is configured for receiving therethrough a fastener and where one or more ribs extend between the first wall and the second wall, along at least a portion of the panel, the fastener location being indicative of the location thereof.

21 Claims, 19 Drawing Sheets

(51) Int. Cl.

| | |
|---|---|
| ***E04C 2/34*** | (2006.01) |
| ***E04C 2/38*** | (2006.01) |
| ***E04C 2/40*** | (2006.01) |
| ***E04B 5/02*** | (2006.01) |
| ***E04F 21/00*** | (2006.01) |

(52) U.S. Cl.
CPC ..... *E04C 2/34* (2013.01); *E04C 2/38* (2013.01); *E04C 2/40* (2013.01); *E04C 2/50* (2013.01); *E04F 21/00* (2013.01)

(56) References Cited

U.S. PATENT DOCUMENTS 2,700,799 A 2/1955 Griffith
D293,925 S 1/1988 Roy
4,889,758 A 12/1989 Rinkewich
4,892,052 A * 1/1990 Zook ..... B63B 3/48 114/355
5,070,667 A * 12/1991 Schulte ..... E04B 1/34321 52/241
5,182,158 A 1/1993 Schaeffer
D347,599 S 6/1994 Johnson et al.
5,411,782 A * 5/1995 Jarvis ..... E04H 4/08 160/229.1
D378,137 S 2/1997 Gregoire
5,836,128 A * 11/1998 Groh ..... E04B 5/12 52/314
5,950,377 A * 9/1999 Yoder ..... E04F 15/10 52/177
6,131,355 A * 10/2000 Groh ..... E04B 5/12 52/314
6,453,630 B1 * 9/2002 Buhrts ..... E04B 5/12 52/177
6,484,467 B2 * 11/2002 Crout ..... E04B 5/12 52/302.1
6,513,297 B2 * 2/2003 Kloepfer ..... B62D 33/046 52/586.1
6,651,398 B2 * 11/2003 Gregori ..... E04B 5/02 182/222
6,718,719 B1 * 4/2004 Hagerty ..... E04D 12/004 52/302.3
6,729,097 B2 * 5/2004 Patel ..... E04C 2/34 52/489.1
6,739,106 B2 * 5/2004 Curatolo ..... E04F 15/10 52/105
D522,147 S * 5/2006 Morton ..... 25/119
D529,623 S 10/2006 Richardson et al.
D548,362 S 8/2007 Ashby et al.
7,533,500 B2 * 5/2009 Morton ..... B29C 47/0028 52/177
D625,834 S 10/2010 McKimmy et al.
D625,835 S 10/2010 McKimmy et al.
7,833,613 B1 11/2010 Rometti
D639,451 S 6/2011 McKimmy et al.
D644,338 S 8/2011 Thuma et al.
D666,738 S 9/2012 McKimmy et al.
8,291,666 B1 * 10/2012 Garrison ..... E04B 1/003 52/177
D688,386 S 8/2013 Donnelly et al.
D691,735 S 10/2013 Thuma et al.
D694,911 S 12/2013 Thuma et al.
D699,372 S 2/2014 Donnelly et al.
8,646,220 B2 2/2014 Kopp et al.
D734,494 S 7/2015 Steiner et al.
2004/0051092 A1 * 3/2004 Curatolo ..... E04F 11/1817 256/19
2004/0079041 A1 * 4/2004 Bergeron ..... E04F 15/10 52/489.1
2005/0223652 A1 10/2005 Mower et al.
2009/0134377 A1 * 5/2009 Petta ..... E04F 11/181 256/65.01
2010/0205871 A1 8/2010 Mower et al.
2011/0011010 A1 1/2011 Mower et al.
2012/0000142 A1 1/2012 McKimmy et al.
2012/0102847 A1 5/2012 Kopp et al.
2014/0182219 A1 7/2014 Thuma et al.

* cited by examiner

PANEL WITH DEFINED FASTENER LOCATION

CROSS-REFERENCE TO RELATED APPLICATIONS

The present application is a U.S. National Phase of PCT/IL2014/050792 filed on Sep. 3, 2014 claiming priority to U.S. provisional application No. 61/873,028 filed Sep. 3, 2013; the disclosure of the PCT Application is hereby incorporated by reference into the present Application.

TECHNOLOGICAL FIELD

The presently disclosed subject matter is in the field of structure assembling. According to a first of its aspects, the disclosure is concerned with a panel fastening system for a structure. According to a second aspect of the disclosure there is a modular door system and a method for its assembly. According to yet an aspect there is disclosed a corner coupler for a structure.

BACKGROUND

Construction assembly of different structures, such as garden cabins, partition walls, fences and the like, has become very common at the DIY market.

An important consideration among DIY manufactures is modularity of components, i.e. the ability to manufacture as little components as possible, however suitable to serve for different purposes. This has an important weight in the overall manufacturing costs.

Yet an important consideration is the provision of easy to assemble components, requiring minimal use of tools, minimal force and only little professional knowledge.

These, along with other criteria, such as light weight components, durability and environmental considerations, such as use of recycled material, render certain products to be desired over other products in the same market.

GENERAL DESCRIPTION

According to a first of its aspects, the present disclosed subject matter calls for an artificial panel of material for use in the assembly of constructions. Such panels are required to be fixed in a tight fashion to a support structure, or required to be attached thereto to various elements such as shelves and the like, typically by fasteners. It is desired to render fastening of such panels in an easy manner, i.e. fast and easy, yet in a sturdy manner.

The term artificial panel as used herein in the specification and claims denotes a panel of material made of molded or extruded material such as different plastic materials. According to one particular embodiment, the panel is made of WPC (a common abbreviation for 'Wood Plastic Composite').

An artificial panel constructed from the above-mentioned materials is considered inferior in strength compared to traditional construction materials such as wood or metal and can also be ductile. Moreover, such materials are often brittle.

An artificial panel according to the first aspect of the disclosure is configured with a spaced apart first wall and second wall, each wall defining an inside surface and an outside surface, and at least one fastener location configured at an outside surface of the panel, for receiving therethrough a fastener.

The term fastener as used herein in the specification and claims denotes a screw (e.g. self threading or regular, a blind rivet, and the like).

The location configured for receiving a fastener is designed to overcome the artificial material inferiority in strength, ductillness, and brittlness compared to traditional construction materials.

Any one or more of the following configurations, designs, and embodiments can be associated with a panel according to the present disclosure, solely or in various combinations:

- The first side wall and the second wall can be of uniform thickness or have a varying thickness;
- The first wall and the second wall can be parallel to one another;
- One or more ribs can extend between the first wall and the second wall, along at least a portion of the panel, at any orientation:
  - The one or more ribs can be parallel to at least one of the first wall and the second wall;
  - The one or more ribs can be perpendicular to at least one of the first wall and the second wall;
  - The one or more ribs can extend inclined with respect to at least one of the first wall and the second wall;
  - The one or more ribs can be conical over at least a portion thereof;
  - The one or more ribs is conical and connected at its apex to the one of the first wall and the second wall through an extension rib, which is substantially thinner that the respective wall to which it connects.
- A fastener location can extend through the first wall and the second wall;
- The one or more ribs can be configured for receiving a fastener therethrough;
- Neighboring ribs can extend in close proximity to one another, with a gap therebetween, said gap constituting threading walls for a fastener to attach thereto;
- The gap between the neighboring ribs can be initially sealed by a wall surface, said sealing being pierced upon introducing a fastener therethrough;
- A pre-formed partial bore can extend thorough at least a portion of the rib, for receiving a fastener therethrough;
- The panel can be configured with male-female edges for mating with respective opposite male-female edges of a neighboring like panel or construction element;
- The male-female edges of the panel are configured for tight, seamless attachment to a neighboring panel;
- The panel can be made of or can comprise a light passing portion;
- The panel can be truculent or opaque;
- The panel can be made of recycled plastic material or of combinations thereof, such as WPC;
- One or both of the first face and the second face of the panel can be texturized and or colored, e.g. to impart it a natural wood-like appearance, a cement wall appearance, etc.;
- When concealed (i.e. with a fastener opening not pre formed at the walls of the panel), a fastener location can be marked e.g. by a groove, an indention and the like, said marking corresponding with the fastener location;
- The panel is configured as an elongate slat for horizontal assembly;
- The panel is configured for at least partially overlapping with a like panel, along their mating edges.

According to the second aspect of the presently disclosed subject matter, there is disclosed a modular, interchangeable door system, wherein same components of the door serve for both a left side door and a right side door.

The door system comprises a main body configured with an outside face, an inside face, a first edge rail-mount and a second edge rail-mount, a hinge stile and a locking stile, a first (TOP) rail and a second (BOTTOM) rail configured for interchangingly articulating to the first edge rail-mount and the second edge rail-mount, and at least one cladding panel configured for attaching over at least a portion of the outside face of the main body, at either an upright or a bottoms-up orientation thereof.

The arrangement being such that the door system can be used as either a 'left door' or a 'right door' by rotating the main body at 180° about the plane of the main body (i.e. into a bottom-up orientation).

Any one or more of the following configurations, designs, and embodiments can be associated with a door system according to the present disclosure, alone or in various combinations:

- At least the main body and the at least one cladding panel are made of molded material, such as plastic, WPC, etc;
- The outside face is an external face of the door;
- The cladding panel is readily replaceable;
- The outside face of the main body can be symmetrical about a partition line;
- The cladding panel can have a decorative appearance and can be, for example, patterned, texturized, colored, etc.;
- The first edge rail-mount and the second edge rail-mount are substantially identical;
- The first (TOP) rail and a second (BOTTOM) rail are substantially identical and interchangeable and configured for top/bottom mount;
- The main body is configured with symmetrically disposed apertures, serving as windows or venting ports, wherein at either position thereof the cladding panel conceals one or more such apertures;
- The cladding panel can be articulated over the outside face of the main body at an upright orientation and at a bottoms-up orientation.

According to a third aspect of the disclosure there is disclosed a corner coupler for securing wall members to one another at an angle about a corner.

The corner coupler according to the disclosure is generally an Ω (omega)-like shaped member comprising an inter-wall gap support from which extend a first wall support arm and a second wall support arm, both disposed at an angle of at least 90° with respect to the inter-wall gap support; the first wall support arm is configured at a free end thereof with a first wall gripping edge, and the second wall support arm is configured at a free end thereof with a second wall gripping edge.

The arrangement is such that when the corner coupler mounted at a corner of two wall members of a structure, the inter-wall gap support is configured for extending between facing edges of the wall members, the first wall support arm and a second wall support arm are configured for bearing against respective portions of the first wall member and the second wall member and the first wall gripping edge and the second wall gripping edge are configured for arresting within a groove extending at the first wall member and the second wall member, respectively.

At the mounted position the corner coupler is secured to the respective wall members by fasteners, such as screws and rivets extending through openings configured at the first wall support arm and the second wall support arm. Additional adhering agents can be applied if required.

Any one or more of the following configurations, designs, and embodiments can be associated with a corner coupler according to the present disclosure, solely or in various combinations:

- The wall support arms can bear flush against the wall members;
- The corner coupler can be made of metal sheet material;
- The corner coupler can be made of elastic sheet material;
- At least the wall support arms of the corner coupler can be elastic;
- The corner coupler can be symmetric about its longitudinal axis, or it can be a-symmetric so as to conform with different shapes of the wall members. For example, differences can take place in any one or more of the following:
  - the length of the first wall support arm and the second wall support arm can be different;
  - the length of the first wall gripping edge can be different from the length of the second wall gripping edge; and
  - the angle of the first wall gripping edge with respect to the first wall support arm can be different from the angle of the second wall gripping edge with respect to the second wall support arm.
- The corner coupler can extend the entire length of the wall members or it can be segmented and be secured to respective portions of the wall members;
- The number and dispersion of apertures formed along the corner coupler can differ;
- The radial extent (length) of the inter-wall gap support can alter so as to span the entire gap between the wall members, or a portion thereof;
- The inter-wall gap support can be made of two spaced apart walls or be a solid portion;
- The outside wall surface of the inter-wall gap support can be parallel to one another or be inclined with respect to one another;
- According to a particular example the first wall support arm and the second wall support arm are spaced apart at 90° and a central axis of the inter-wall gap support is disposed at 135° with respect to the wall support arms (i.e. at 180° with a bisector extending between the first wall support arm and the second wall support arm); according to yet a particular example the first wall gripping edge and the second wall gripping edge are disposed at a 90° with respect to the wall support arms
- The wall gripping edge extend from an edge of the respective wall support arms, with an intermediate indent bulging inwards in direction of a space between the support arms;
- An edge of the inter-wall gap support can extend the entire gap between the wall members;
- An edge of the inter-wall gap support can be configured with a concealing cover to be fitted at an external face of the wall members;
- The first wall support arm and a second wall support arm are disposed at an obtuse angle with respect to the inter-wall gap support; and/or
- The first wall support arm and a second wall support arm are disposed at an angle slightly greater than their nominal angular value, so as to generate an engaging force bearing within the groove at the respective wall members.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1:
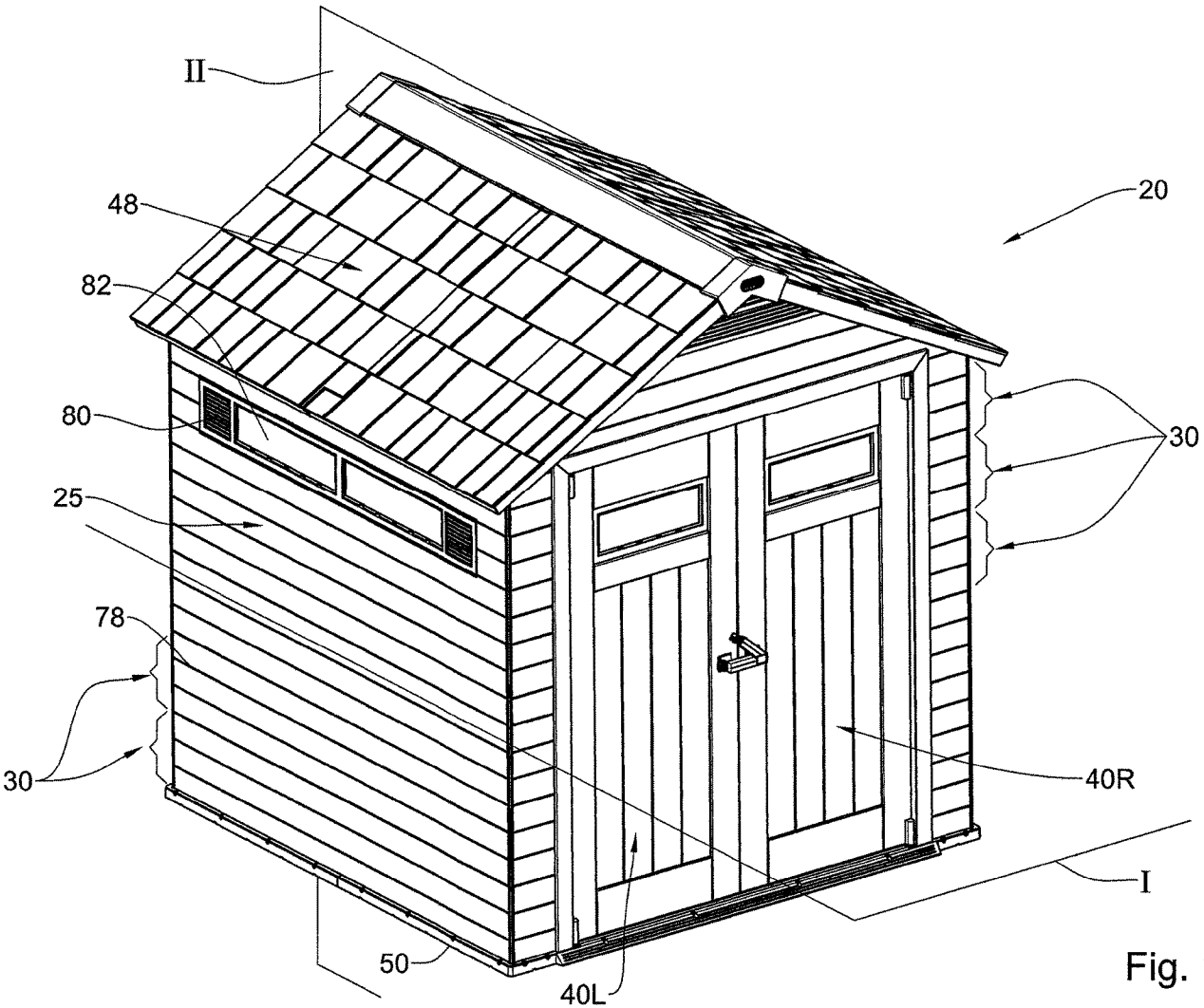
FIG. 1 illustrates a structure constructed with side walls composed of panels according to a first aspect of the present disclosure, the structure further configured with a modular, interchangeable door system according to a second aspect of the present disclosure.

Attention is first directed to FIGS. 1 and 2 of the drawings, illustrating a cabin generally designated 20, comprising walls 25 (front, rear and side walls), all made of horizontally disposed panels, said panels generally designated 30. The cabin further comprises a front door composed of a right wing door 40R and a left wing door 40L, roof 48, a floor 50 and other elements not seen in FIG. 1

Figure 3A:
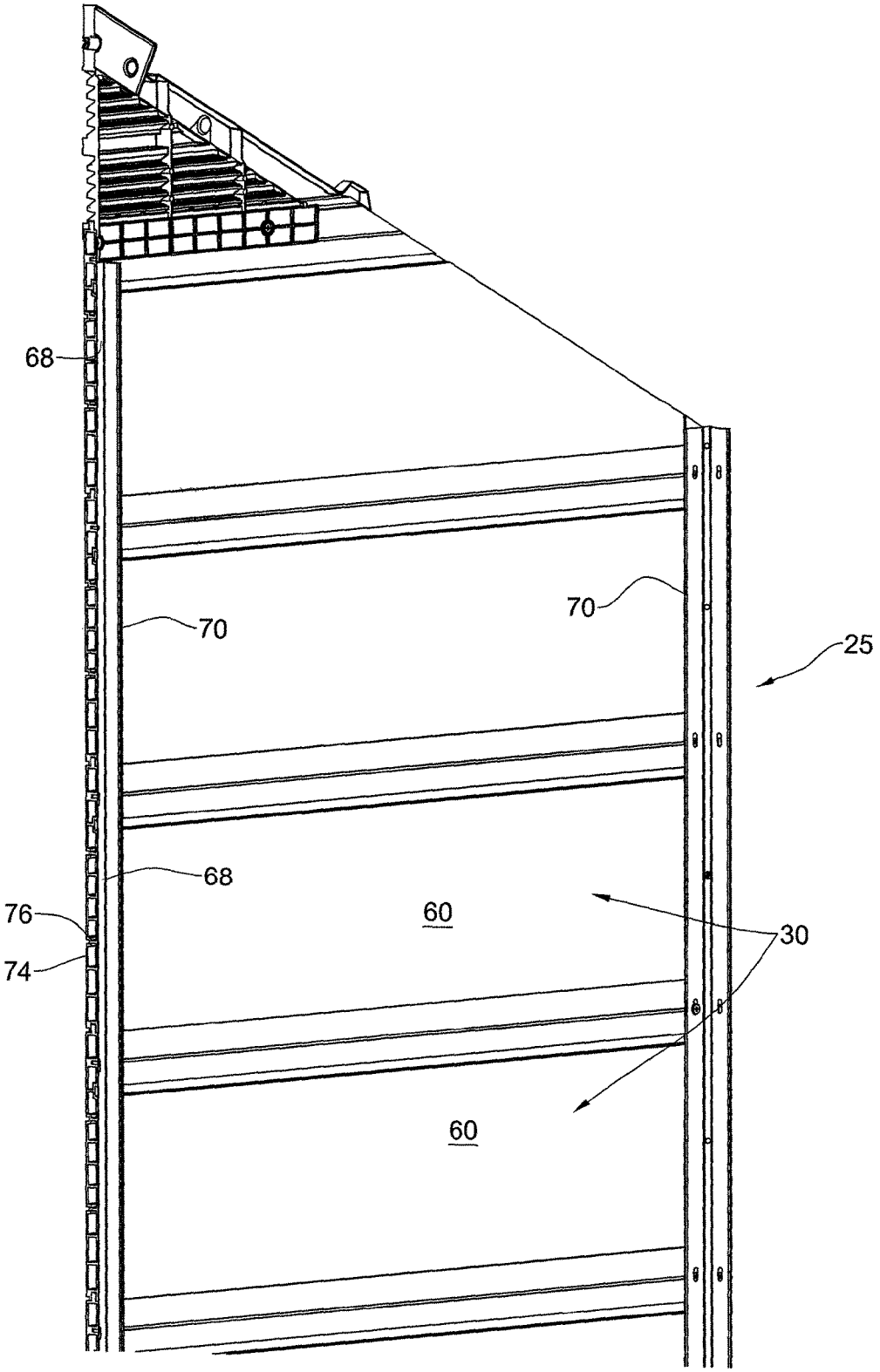
FIG. 3A is an enlarged view of the portion marked III in FIG. 2B.
Figure 3B:
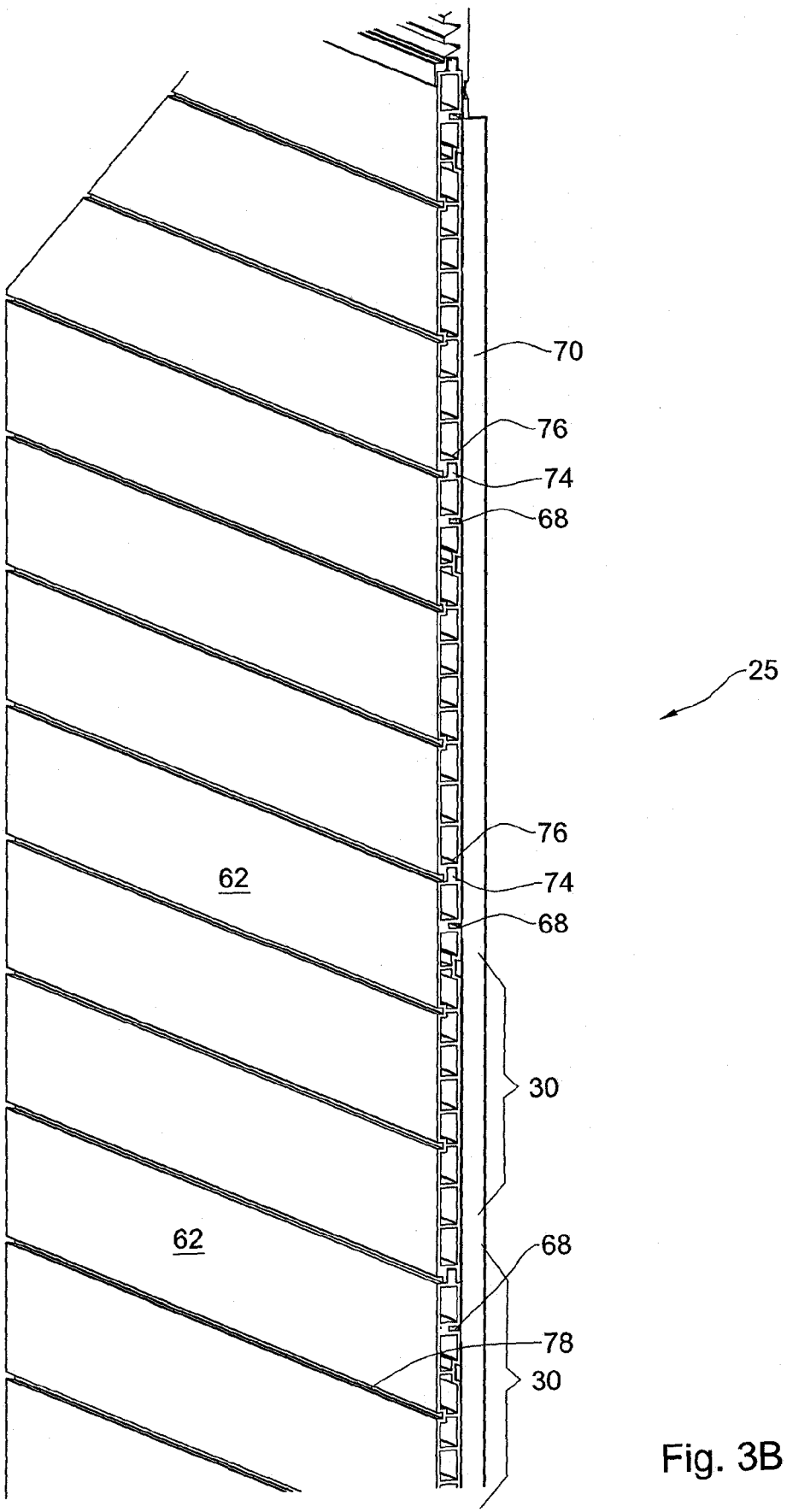
FIG. 3B is a view of the portion illustrated in FIG. 3A from the outside thereof.
Figure 4A:
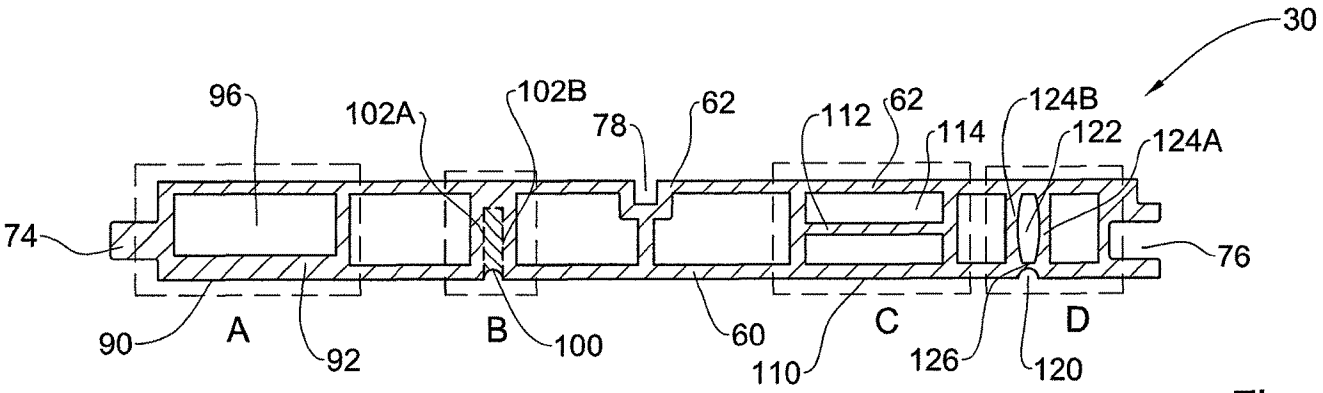
FIG. 4A is a schematic section through a panel according to the first aspect of the present disclosure, the panel illustrating different fastener locations.
Figure 4B:
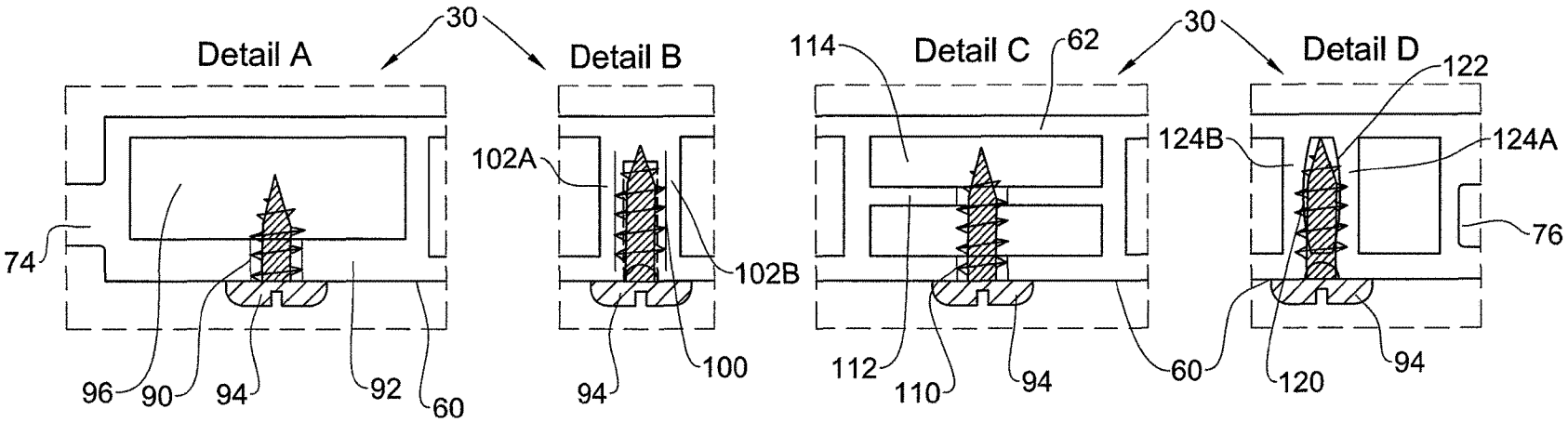
FIG. 4B illustrates the panel of FIG. 4A, with fasteners secured at the different fastener locations.

As mentioned, and as can best be seen in FIGS. 3A and 3B, the panels 30 are horizontally disposed. The panels 30 are made of molded or extruded material, such as plastic materials, WPC (Wood Plastic Composite), etc., with a variety of additives possibly added thereto, e.g. color, UV repellent, etc. Each panel 30 comprises a first (inside surface) wall 60 and a parallely disposed, spaced apart, second (outside surface) wall 62. Each of the panels 30 is formed at its inside face 60, with a plurality of fastener locations designated 68, for receiving a fastener therethrough (FIG. 4B) and securing the panel 30 to a support member such as a beam (mullion/muntin) 70, or for mounting to the panel an article, such a shelf, picture and the like (not shown). FIGS. 4A and 4B make particular reference to different examples of fastener locations.

It is further seen that the horizontally disposed panels 30 are configured with male-female engaging elongate edges 74 and 76, respectively (best seen in FIG. 4A).

The panels 30 have a smooth, flat inside surface 60, whilst the outside surface 62 is formed with a longitudinally extending groove 78 (FIGS. 3B and 4A) imparting a single panel 30 with the appearance of several panels articulated to one another. Likewise, the male-female engaging elongate edges 74 and 76, respectively provide tight and water resistant attaching of neighboring panels 30, yet with an eye pleasing gap (non functional), and extending at a fixed vertical distance, with some overlapping between mating edges of neighboring panels.

Different aesthetic features can be imparted to the panels, such colors and patterns and likewise, the panels can be or comprise translucent (see through or light-passing) portions. Also, the panels 30 can comprise venting grids 80, widows 82 (fixed or openable).

Turning now to FIGS. 4A and 4B particular examples of fastener locations are illustrated and exemplified. In the present examples the illustrated fastener is a self screw 94 (e.g. self tapping screw), though it is appreciated that other types of fasteners can be used, such as other types of screws and blind rivets.

Detail 'A' in FIGS. 4A and 4B is directed to a fastener location designated 90, wherein a thickened wall portion 92 is provided at the inside surface of inside wall 60 of the panel 30, with a self screw 94 threaded directly into the fastener location 90 and projecting into the internal space 96 of the panel. If desired, a noticeable mark can be applied on the surface of the panel (not shown, however such a mark can be a slight groove similar to that illustrated in connection with detail 'D' discussed hereinafter, or an indentation (not shown), such a visible mark can serve for easy identifying the locations of the fastener location and for eye-pleasing equi-distant applying of fasteners.

Detail 'B' in FIGS. 4A and 4B is directed to a fastener location designated 100 which is a narrow gap between two neighboring ribs 102A and 102B. the gap 100 can be a bore open at the inside surface of wall 60 of the panel, or it can be filled with a soft material, such as a resin and the like, for eye pleasing, i.e. such that unused fastener locations are not open bores seen at the inside of the panel. Screw is screwed and retained within the tight gap 100. It will be appreciated that the gap can be non existent such that the rib is substantially solid, made from the same material as the remainder of the panel.

Detail 'C' in FIGS. 4A and 4B is directed to a fastener location designated 110 wherein a rib 112 is disposed parallely between inside wall 60 and outside wall 62, and where a self screw 94 is threaded directly into the fastener location 110 and penetrates through both the wall 60 and the rib 112, projecting into the internal space 114 of the panel.

If desired, a noticeable mark can be applied on the surface of the panel (not shown), however such a mark can be a slight groove or notch similar to that illustrated in connection with detail 'D' discussed hereinafter, or an indention (not shown). Such a visible mark can serve for easy identifying the locations of the fastener location and for eye-pleasing equi-distant applying of fasteners. It will be appreciated that the mark can also be an outwardly protruding element.

Detail 'D' in FIGS. 4A and 4B is directed to a fastener location designated 120 in the form of a longitudinal groove 122 extending through the panel 30 between two parallel ribs 124A and 124B and with a groove or indention 126 formed at the inside face of inside wall 60, for identification and easy location of the fastener location 120, such that a self screw 94 can easily be threaded into the fastener location 120.

Figure 4C:
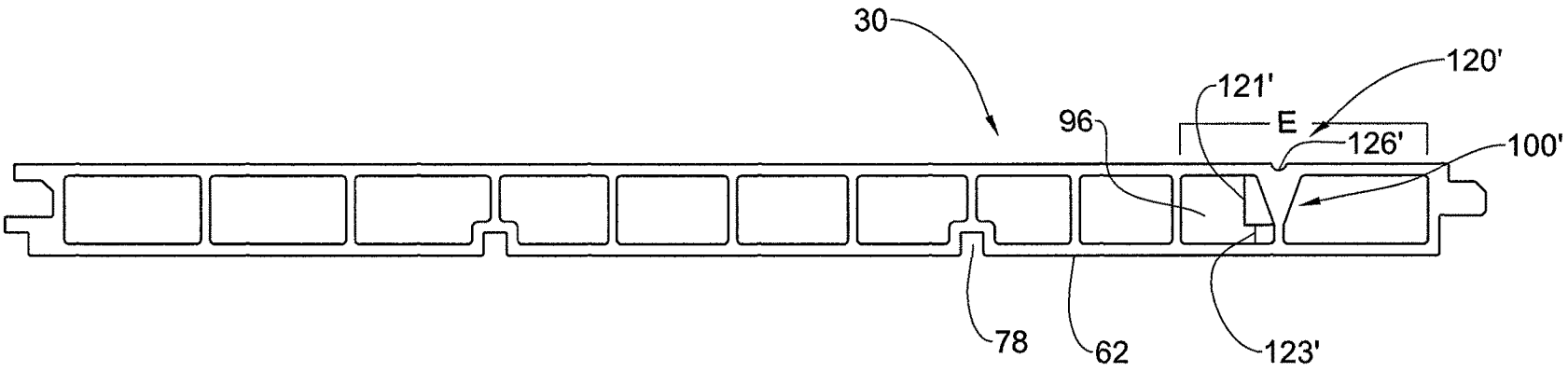
FIGS. 4C and 4D illustrate a schematic section through a panel according to another example of the disclosed subject matter, illustrating yet another fastener location in FIG. 4C, with FIG. 4D illustrating a fastener secured at the fastener location.
Figure 4D:
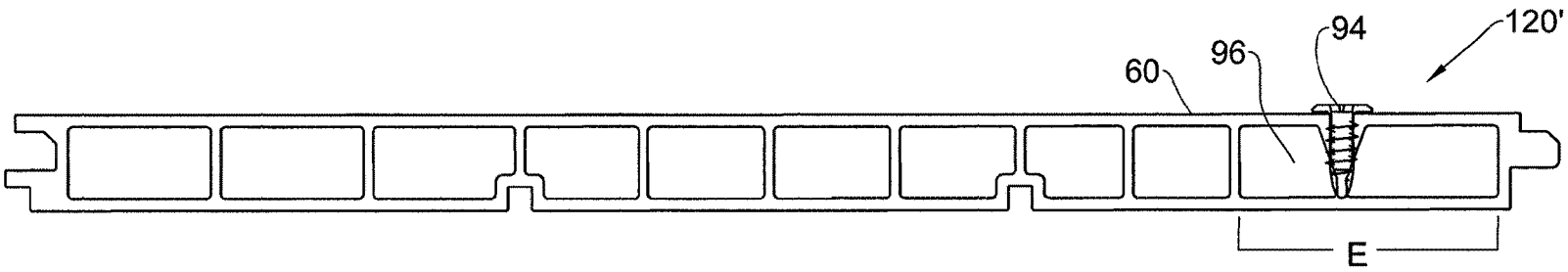
Figure 5A:
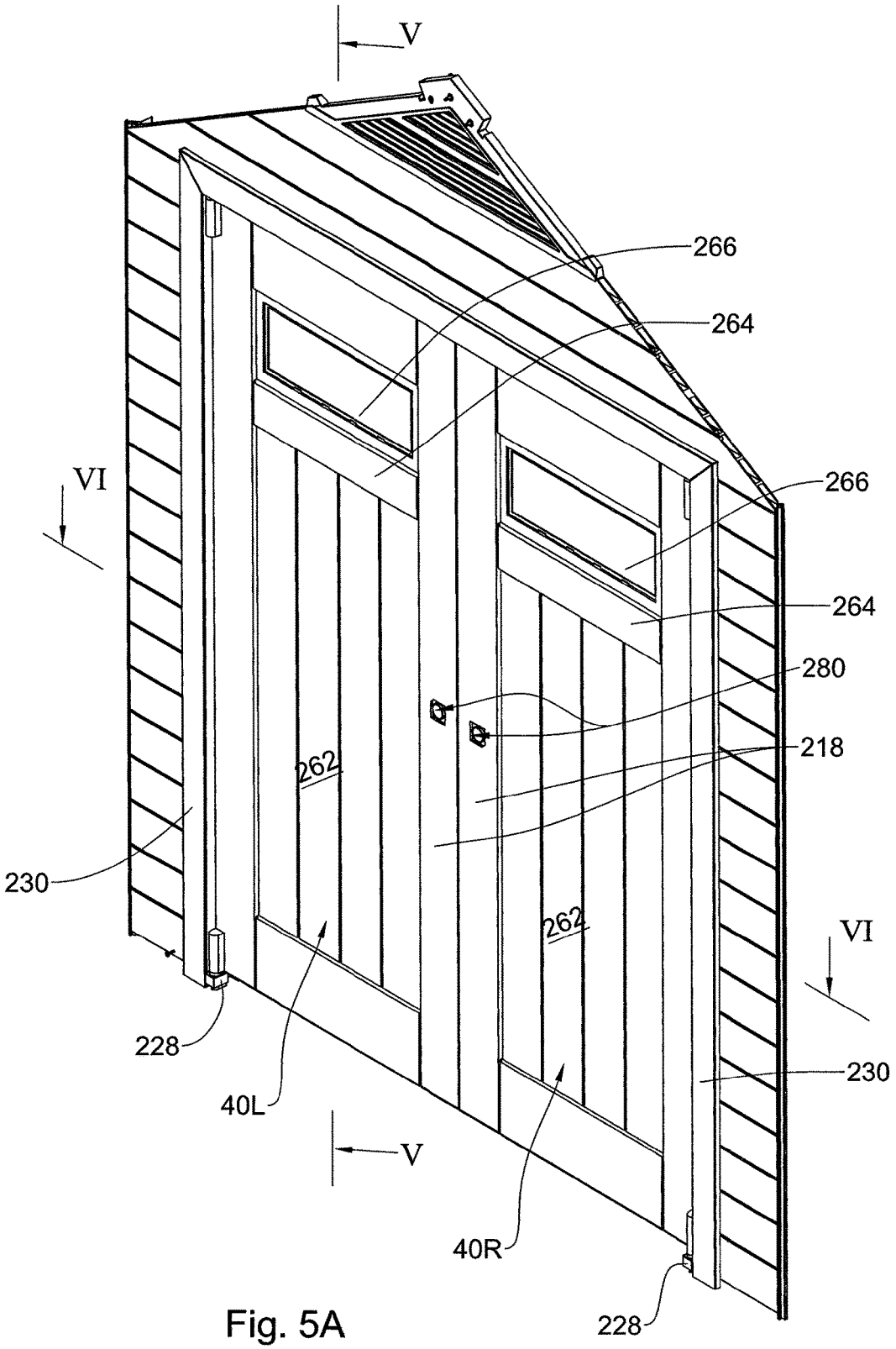
FIG. 5A is a perspective front view of a front wall of a cabin, configured with two doors according to a second aspect of the present disclosure.
Figure 5B:
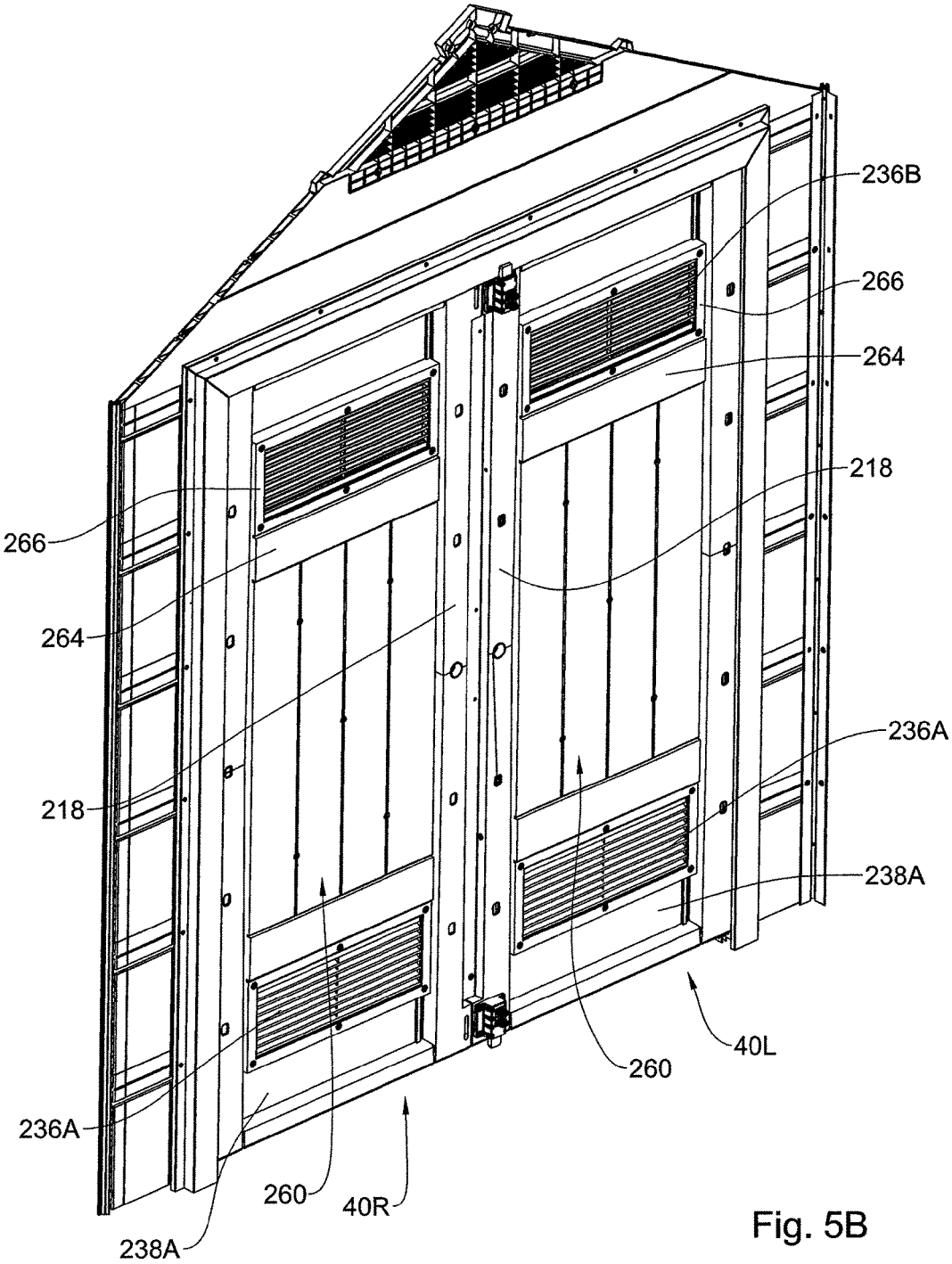
FIG. 5B is a perspective rear (inside) view of FIG. 5A.
Figure 6A:
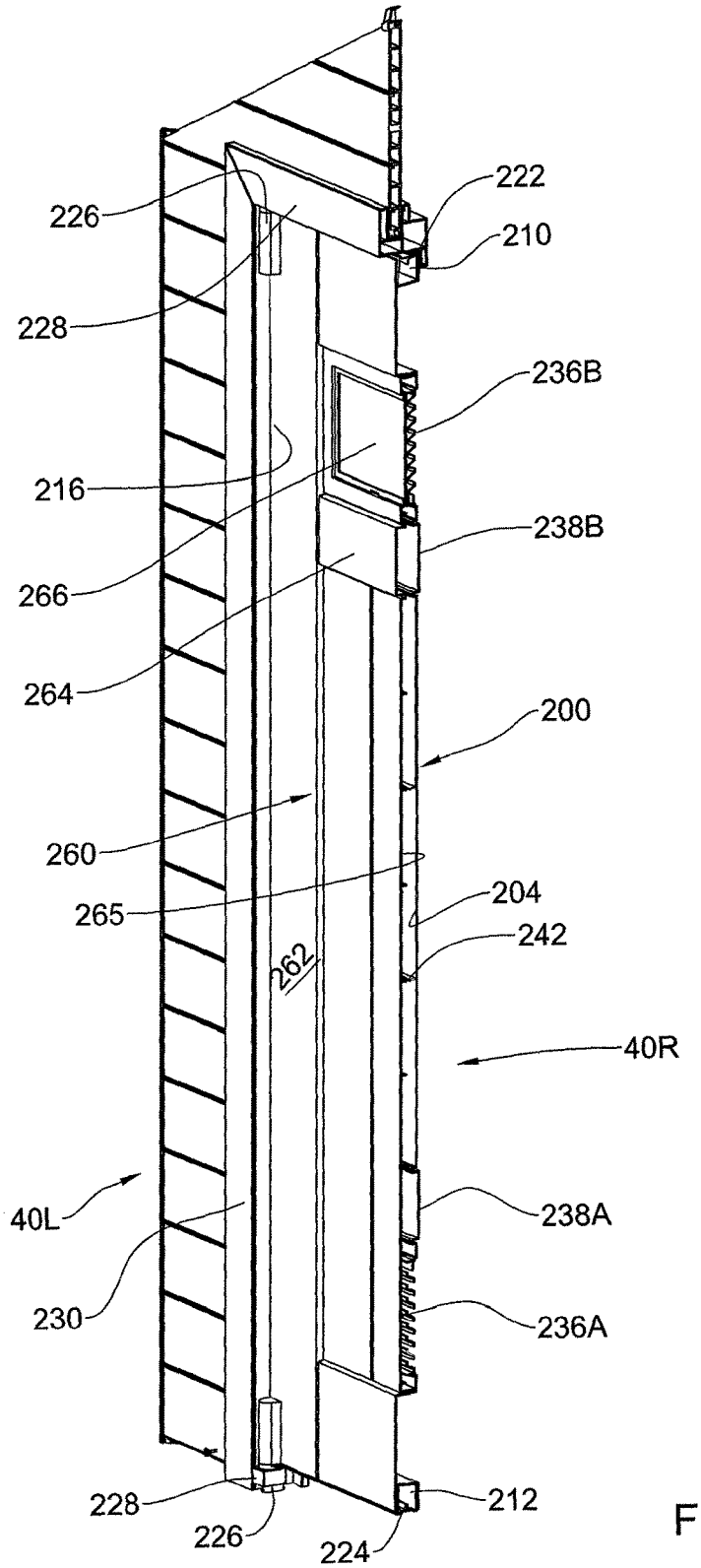
FIG. 6A is a vertical section through an assembled door, taken along line V-V in FIG. 5A.
Figure 6B:
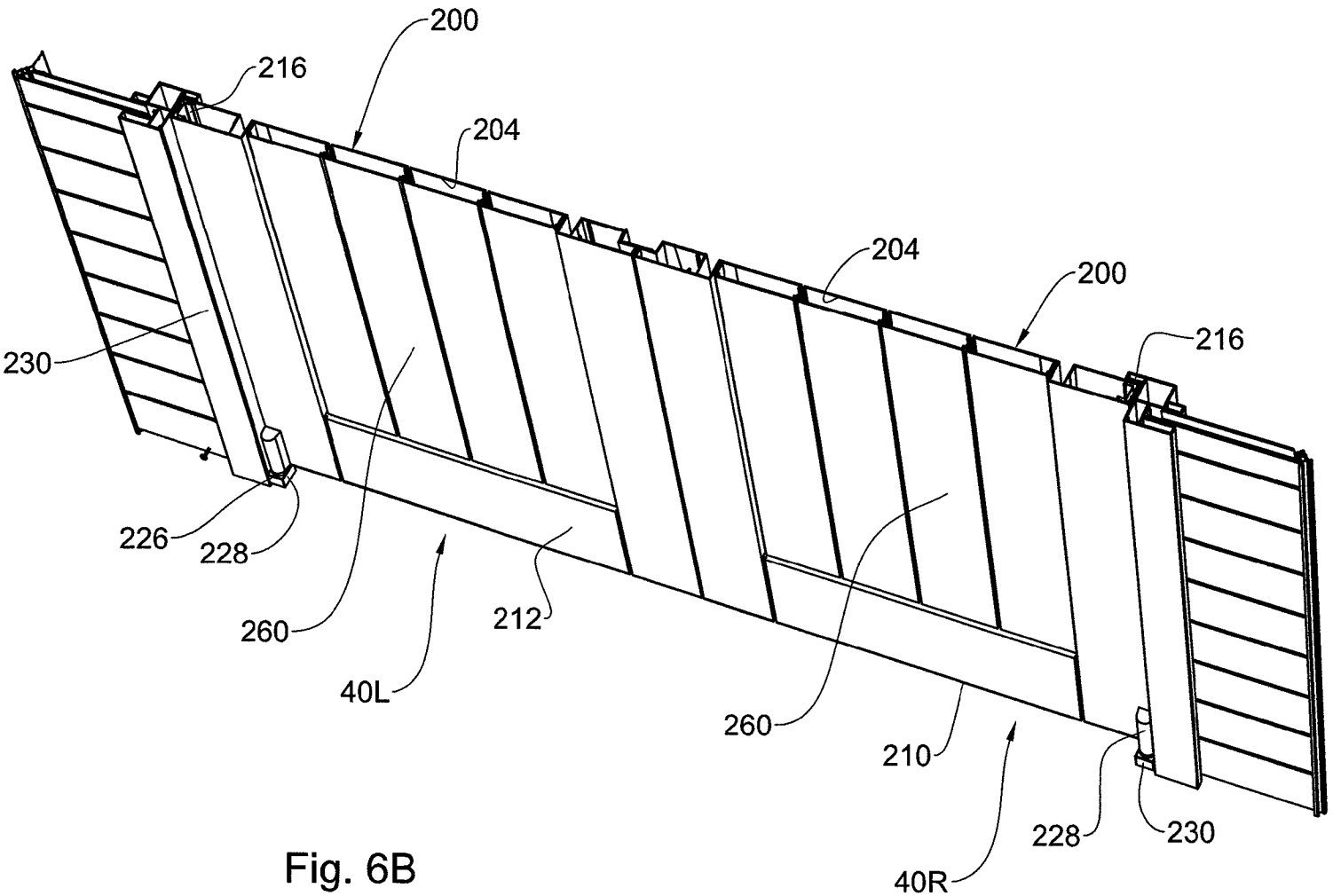
FIG. 6B is a horizontal section through an assembled door, taken along line VI-VI in FIG. 5A.

FIGS. 4C and 4D illustrate another example of the fastener location designated 120' (same elements are designated using same numerals as in connection with the previous example, while elements having different configuration, are marked with "'" following the numeral). Detail 'E' in FIGS. 4C and 4D is directed to a fastener location designated 100' which is in the form of a solid conical rib extending between the two opposite walls 60 and 62. It will be appreciated that the central longitudinal axis of the rib, is perpendicular to the walls 60 and 62. As in the previous example, the outer face of the inner wall 60 comprises a groove or indention 126', for identification and easy location of the fastener location 100', such that a self screw 94 can easily be threaded into the fastener location 100'.

The fastener location in the form of a conical rib 100' is comprised in accordance with this example of a conical solid portion 121 and a narrower extension rib 123 connecting the conical portion to the inside surface of the outer wall 62, such that the fastening element, e.g. a screw as seen in FIG. 4D, extends substantially therethrough. It will be appreciated that the screw can be screwed into the conical portion 121 only. This structure allows having a solid fastening location for tight threading, while the outer wall 62 of the panel is not affected by sink marks, which might result from fastener locations having a broader rib portion connecting to the outer wall 62 of the panel 30. This maintains an eye-pleasing surface on the outer wall, without giving a hint to the presence of the rib and the screw threaded therethrough. In addition, such a configuration allows economy in the plastic material used for the panel. The screw in accordance with an example of the disclosed subject matter can at least partially outwardly extend (e.g. its threads) beyond outer surface of the rib, thus to a certain degree resembling the function of the masonry anchor. It will be appreciated that the conical portion of the rib can be provided with a bore, e.g. filled with a soft material.

As seen in any one of the details described hereinabove, the screw does not require a fastening bolt and yet it does not penetrate through an external face of the panel, however without deteriorating fastening/gripping force of the bolt to the panel. The screw screws into the rib and is maintained securely in its position without unintentional falling out, or causing any damage to the outer surface such as cracks which might appear due to the type of the material used which is often brittle when compared with other materials. In particular, with panels having relatively thin walls which might be needed due to weight considerations or material saving considerations, it will be a tendency of a composite material for example such as WPC to exhibit fragility/brittleness when screwed into. Provision of the fastening locations in accordance with the disclosed subject matter allows reducing and preventing such unintentional defects.

It is appreciated that the provision of air voids in the panel improved its thermal and noise isolation properties, and further, that the provision of support ribs improved rigidity of the panels.

Attention is now directed to FIGS. 5 to 9 directed to a second aspect of the present disclosure, concerned with a modular door.

The cabin 20 is configured at its front wall with a right door 40R and a left door 40L (also seen in FIG. 1). As will become apparent hereinafter, the two doors 40R and 40L are composed of same components, rendering the system modularity, simplicity and cost effective.

Each of the door systems comprises a main body 200 made of molded plastic or WPC material and configured with an outside face 204, an inside face 208 bounded between a first (top) edge rail-mount 210 and a second (bottom) edge rail-mount 212, a hinge stile 216 and a locking stile 218.

Snapingly articulated within the first (top) edge rail-mount 210 there is received a first (top) rail 222 and likewise, a second (bottom) rail 224 is snapingly articulated within the first (top) edge rail-mount 210. Each of the first rail 222 and the second rail 224 is fitted with a projecting hinge portion 226 (best seen in FIG. 7A) and configured for rotatably receiving within a door bushing 228 of the door jamb 230.

According to a particular configuration, the first (top) rail 222 and the second (bottom) rail 224 are identical and are configured for interchangingly articulating within either the respective first (top) edge rail-mount 210 and the second (bottom) edge rail-mount 212. However, in such a configuration the projecting hinge portion is configurable for respective projecting upwards or downwards such that after mounting on the respective top or bottom edge it projects from the door. This can be obtained by a fixed hinge projection extending at both sides of the rail, or for example by a hinge projection displaceably mounted between a top projection configuration and a bottom projecting configuration, respectively.

As seen in the figures, the main body 200 is configured with a central portion 234 in the form of solid sheet panel symmetrically extending between the hinge stile 216 and the locking stile 218 and between two venting grid portions 236A and 236B and further, two window portions 238A and 238B. The central solid portion 234 is configured at its front face 204 with a plurality of reinforcing ribs 242 (longitudinal in the present example) projecting from the surface of the front surface. The back, inside face 208, is substantially flat though texturized with longitudinal grooves 246 so as to impart the central portion with a mating panel-like appearance.

The central portion 234 and the venting grid portions 236A and 236B are configured with a plurality of openings 250 and the front surface of the central portion 234 and the venting grid portions 236A and 236B are configured with a plurality of snap locations 254.

A cladding panel 260 is configured with a flat outside panel portion 262 (designed with a grid pattern for imparting a mating-like panel appearance), a translucent window portion 264 conforming as far as shape and size with the venting grid portions 236A and 236B, and a venting portion 266 conforming as far as shape and size with the window portion 238A and 238B. In the particular example the window portion 264 is an opening in the cladding panel, though according to a different example (not shown) the venting portion can be a grid-like portion.

An inside face of the panel portion 265 is configured with a plurality of coupling bolts 270 sized and spaced apart in register with the plurality of openings 250 configured at the main body 200, and a plurality of snapping members 274 extending in register with the plurality of snap locations 254 configured at the main body 200.

The cladding panel is mounted and secured to the outside face 204 of the main body 200 by snap articulation of the snapping members 274 of the cladding panel 260 to the snap locations 274 of the main body 200, and further by screws extending from the inside face 208 of the main body 200, through openings 250 and coupled to the bolts 270 of the cladding panel 260.

It is seen that the cladding panel can be articulated to the outside face 204 of the main body 200 at either an upright position (right side door configuration) or a bottoms up position of the main body 200 upon rotating at 180° in the plane of the door (arrowed line 213 in FIG. 9; left side door configuration), wherein the cladding panel 260 remains at an upright position as indicated by arrow 215, i.e. its orientation does not change while assembling a door at either orientation thereof.

In both a right side door orientation (FIG. 8) and a left side door orientation (FIG. 9) the cladding panel 260 covers (covers so as to conceal and render same nonfunctional) the respective bottom venting grid portion 236A and the respective, whilst the respective top venting grid portions 236B and the respective top window portion 238B remain functional, i.e. the top venting grid portion 236B of the main body extends in register with the window portion 264 of the cladding panel 260 and the top window portion 238B of the main body 200 extends in register with the translucent window portion 264 of the cladding panel 260.

According to the disclosed arrangement, the door system disclosed hereinabove can be configured as either a right door configuration or a left door configuration, however using the same components, rendering the door system complete modularity.

It is appreciated that the door system can be configured with any one or both of the venting units and the window.

Figure 7A:
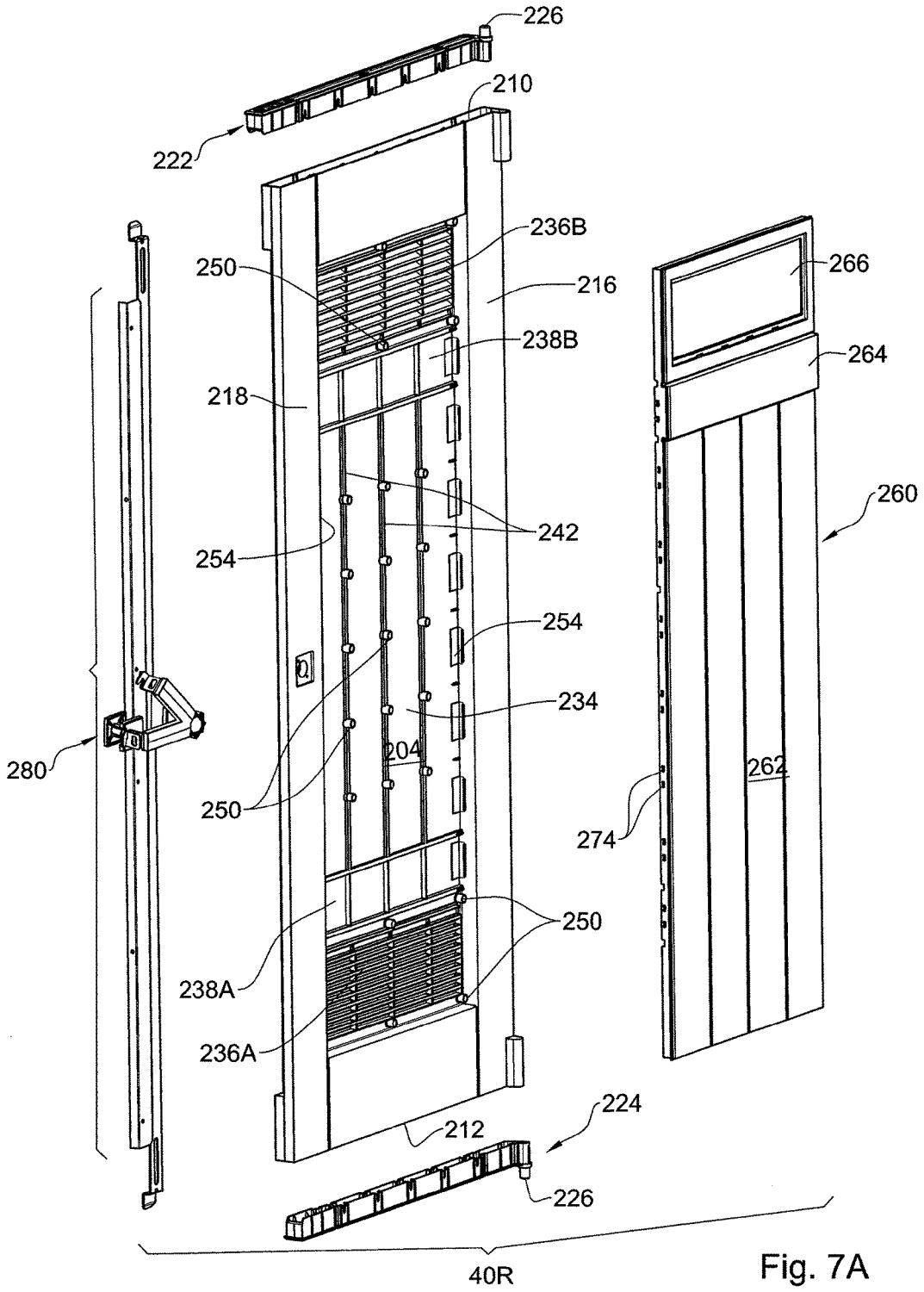
FIG. 7A is an exploded front perspective view of a right door seen in FIG. 5A.
Figure 7B:
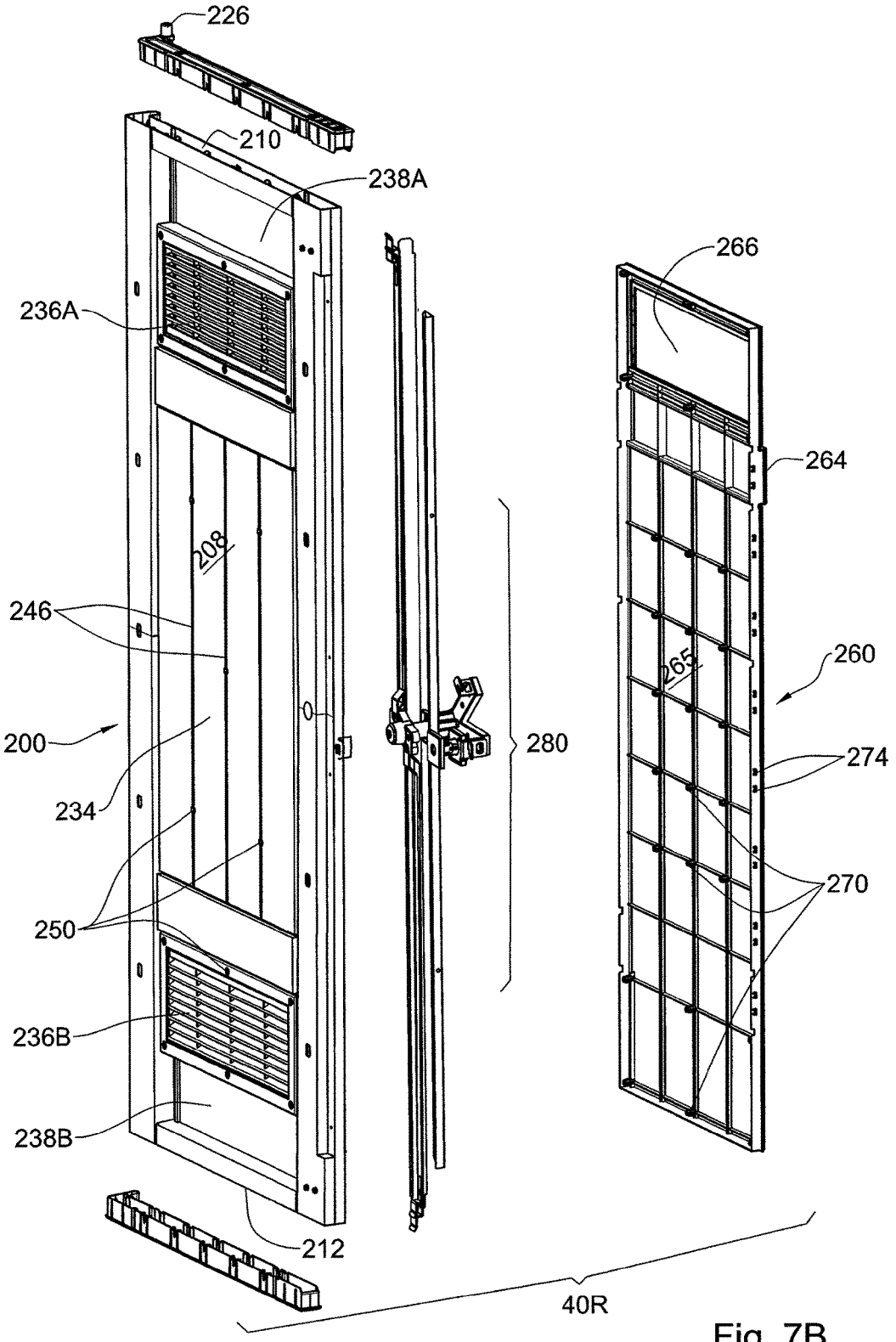
FIG. 7B is a rear view of FIG. 7A.
Figure 8:
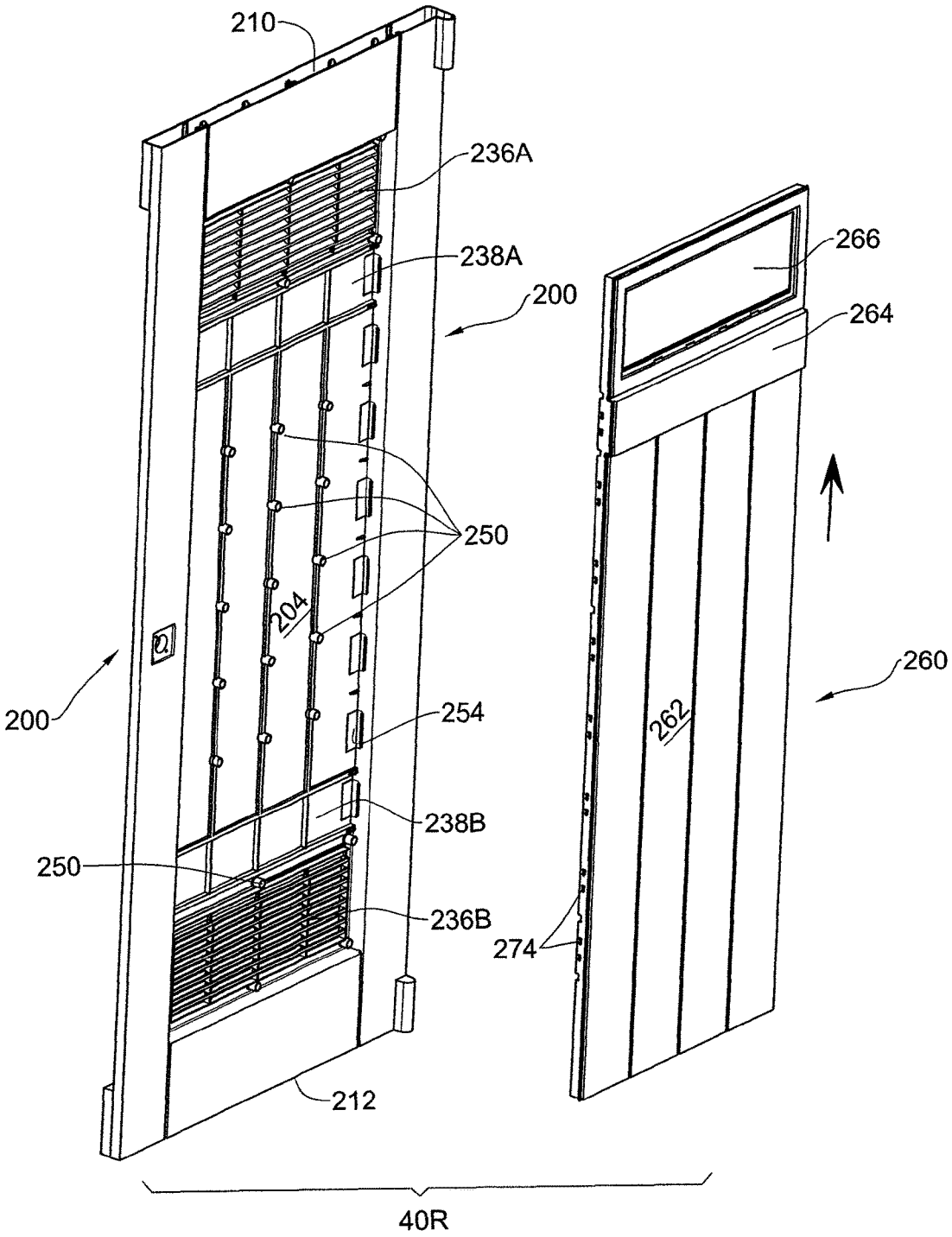
FIG. 8 is an exploded perspective front view of the door's main body and the cladding panel at a right wing door configuration.
Figure 9:
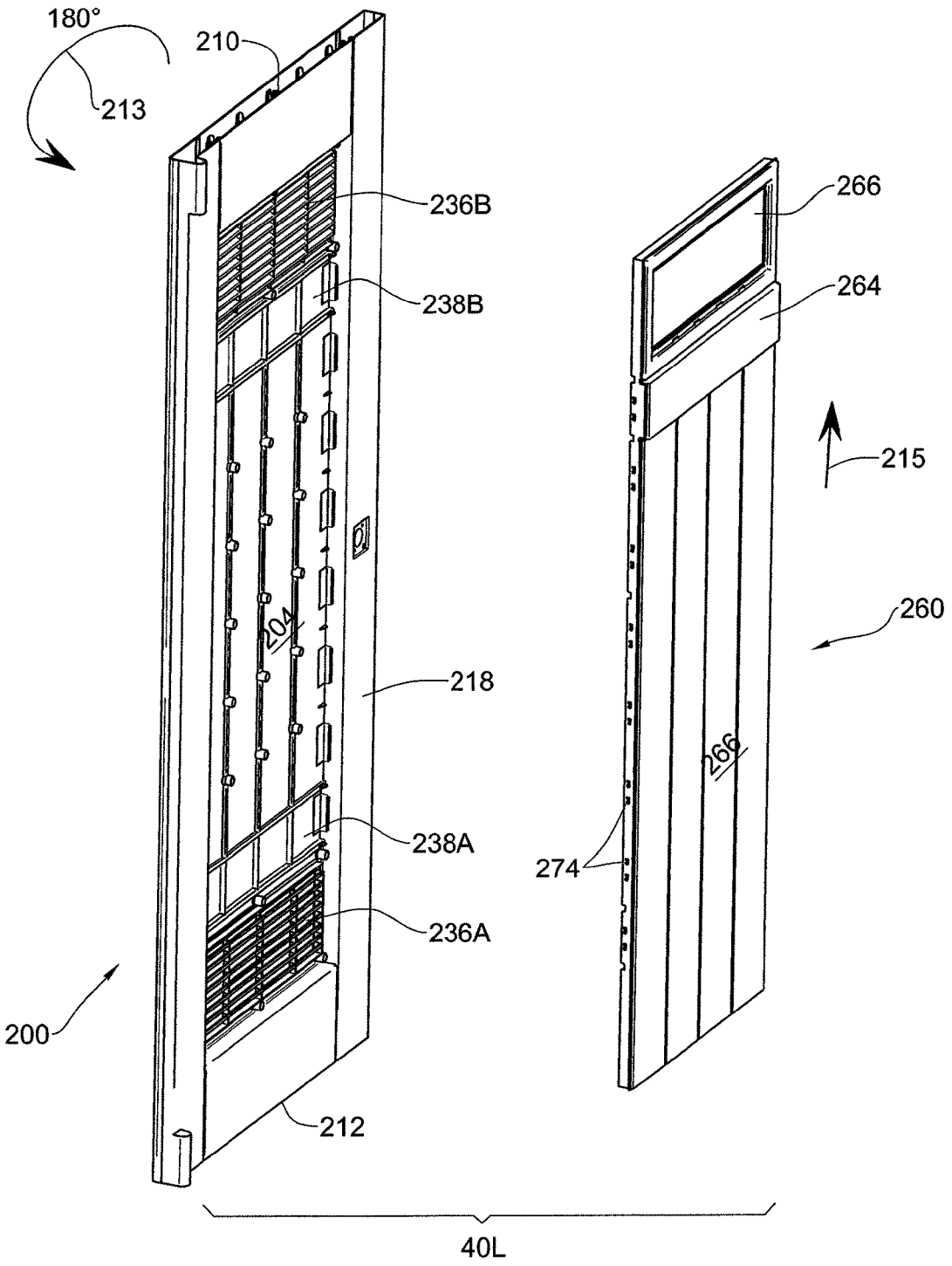
FIG. 9 is an exploded perspective front view of the door's main body and the cladding panel at a left wing door configuration.

The door is further fitted with a locking system generally designated 280 comprising a lock, a lever and vertically displaceable locking latches (FIG. 7A).

It is also appreciated that while in the disclosure above the door system comprises a single cladding panel configured for articulation at a front face of the door (i.e. external face of a door), a cladding panel may also be applied at an inside face of the door and even more so, the cladding panel can be composed of several panel segments.

Further attention is now directed to FIGS. 10 to 13 of the drawings, directed to a third aspect of the present disclosure, concerned with a corner coupler configured for coupling two wall members.

Figure 2A:
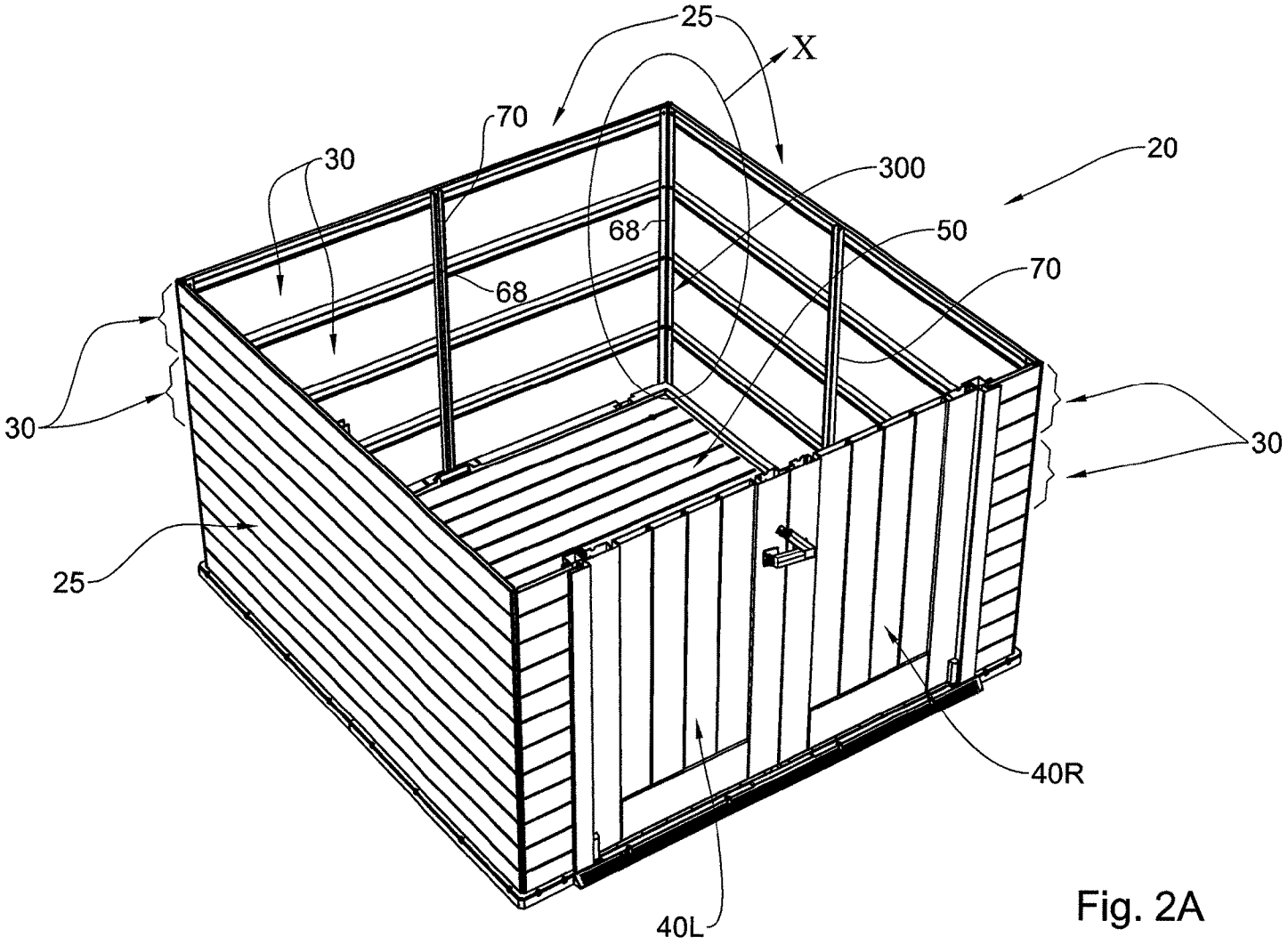
FIG. 2A is a horizontal planer section along plane I in FIG. 1.
Figure 2B:
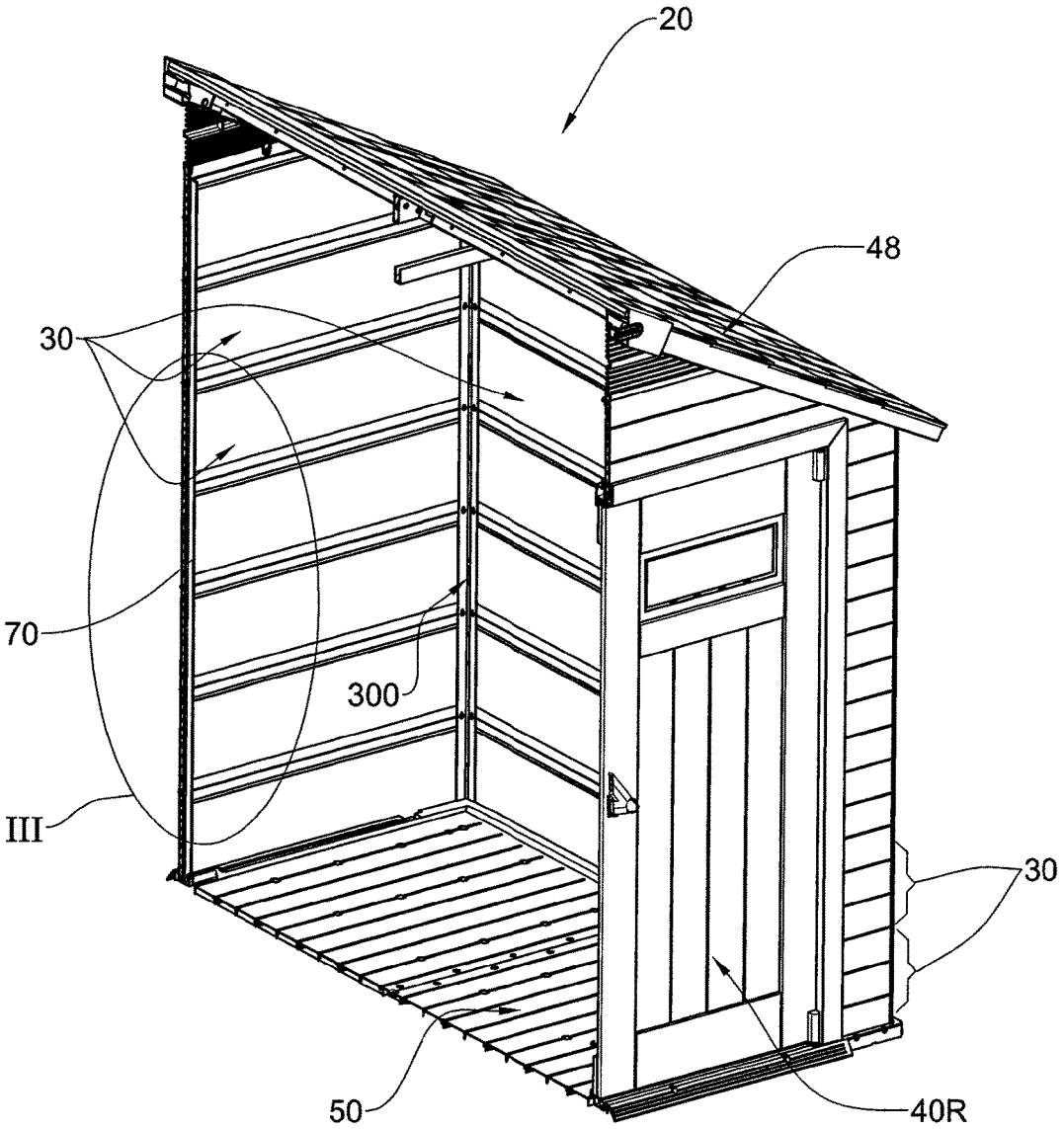
FIG. 2B is a vertical planer section along plane II in FIG. 1.
Figure 10:
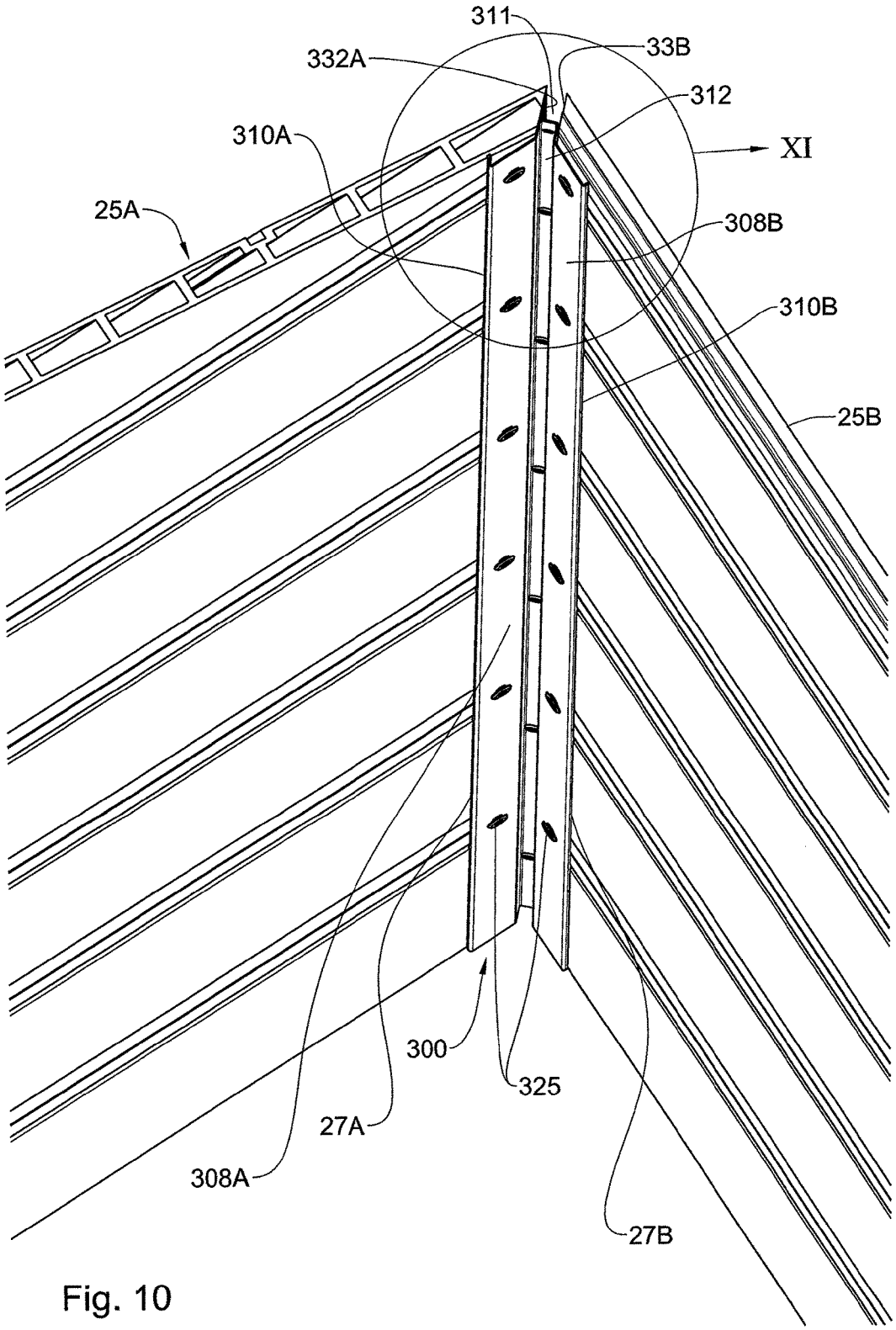
FIG. 10 is an enlarged view of the portion marked X in FIG. 2A, illustrating a corner of the structure configured with a corner coupler according to a third aspect of the disclosure.

As seen in FIGS. 2A and 2B, and better so in FIG. 10, the cabin 20 has wall members designated 25A (back wall of the cabin 20) and 25B (right side wall of the cabin 20) articulated at a corner of the cabin through a corner coupler generally designated 300.

As can be seen in the drawings, the corner coupler 300 is generally a symmetric Ω-like shaped metal-sheet member, comprising a U-like shaped inter-wall gap support 304 from which extend a first wall support arm 308A and a second wall support arm 308B, both disposed at an angle $\alpha$ of at least 90° with respect to the inter-wall gap support 304. The first wall support arm 308A is configured at a free end thereof with a first wall gripping edge 310A, and the second wall support arm 308B is configured at a free end thereof with a second wall gripping edge 310B.

Whilst in the present disclosure the interconnecting portion 312 of the inter-wall gap support 304 is straight and disposed at 90° with respect to its side members 314A and 314B (parallely disposed), an arched configuration can be formed as well, concave or convex with respect to a bisector X symmetrically extending between the first wall support arm 308A and the second wall support arm 308B.

The first wall support arm 308A and the second wall support arm 308B as well as the interconnecting portion 312 of the inter-wall gap support 304 are configured with a plurality of openings 320. The openings formed at the first wall support arm 308A and the second wall support arm 308B are configured for coupling the corner coupler 300 to the wall members 25A and 25B, respectively, through a plurality of screws 325. Openings 320 at the interconnecting portion 312 of the inter-wall gap support 304 serve for securing an external cap profile 330 (represented in FIG. 11 by dashed lines) concealing an outside of the gap 311 (referred to as an 'inter-wall gap').

The arrangement is such that when the corner coupler 300 is mounted at a corner between two wall members 25A and 25B of the cabin 20, the inter-wall gap support 304 extends between facing chamfered edges 332A and 332B of the wall members 25A and 25B, respectively, with said chamfered edges 332A and 332B bearing against the side members 314A and 314B of the inter-wall gap support 304, and the first wall support arm 308A and the second wall support arm 308B bear against respective portions of the first wall member 25A and the second wall member 25B, with the first wall gripping edge 310A and the second wall gripping edge 310B bearing within a groove 27A and 27B (best seen in FIG. 11) of the wall member 25A and the second wall member 25B, respectively.

Figure 11:
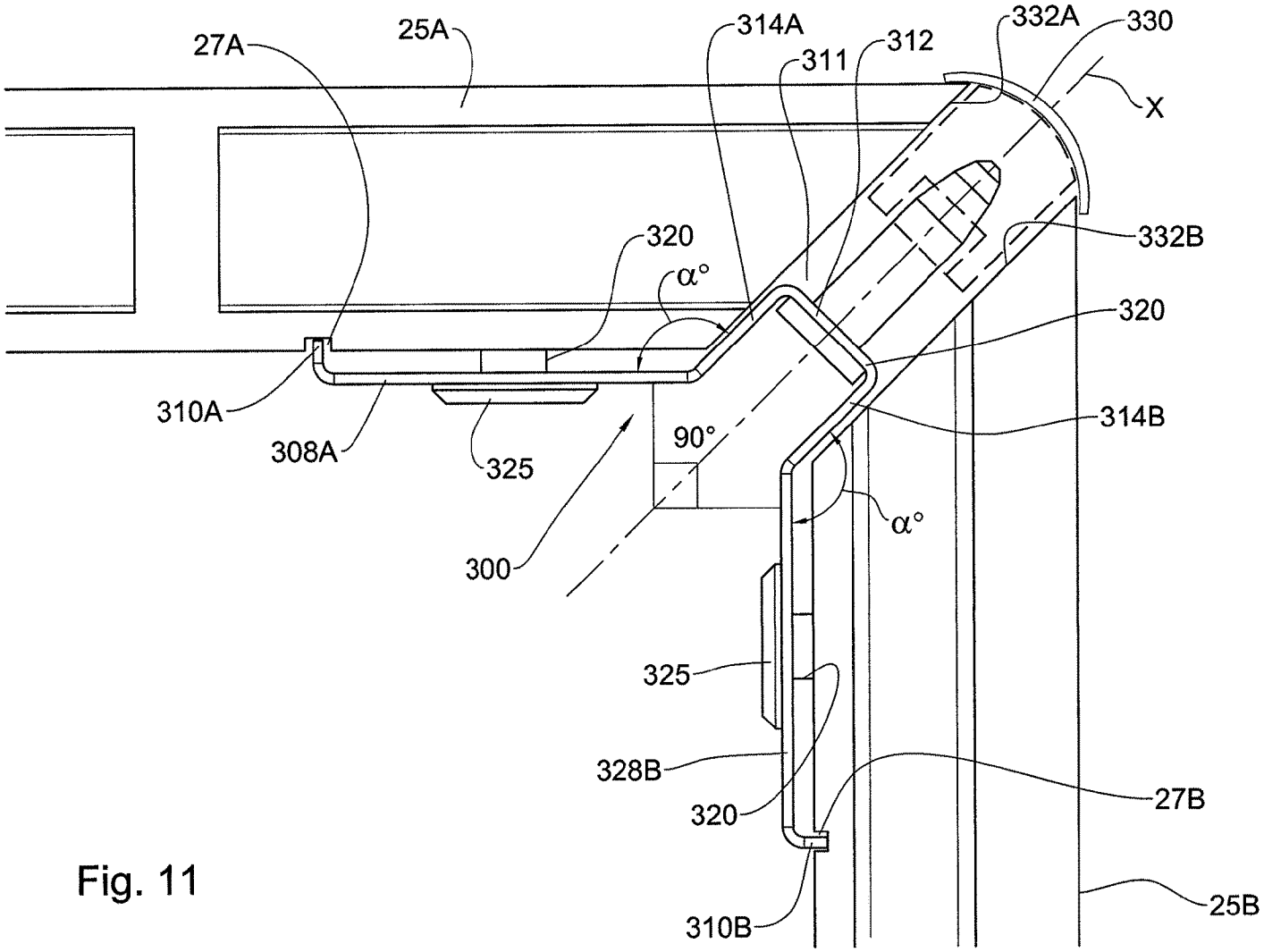
FIG. 11 is an enlarged top view of the portion marked XI in FIG. 10.

It is seen that in FIG. 11 the first wall support arm 308A and the second wall support arm 308B are slightly spaced apart from the respective wall members 25A and 25B, wherein the extent of fastening the screws 325 governs elasticity thereof. However, in the example of FIG. 13 first wall support arms bear flush against the respective wall members, as will be explained hereinafter.

Figure 12:
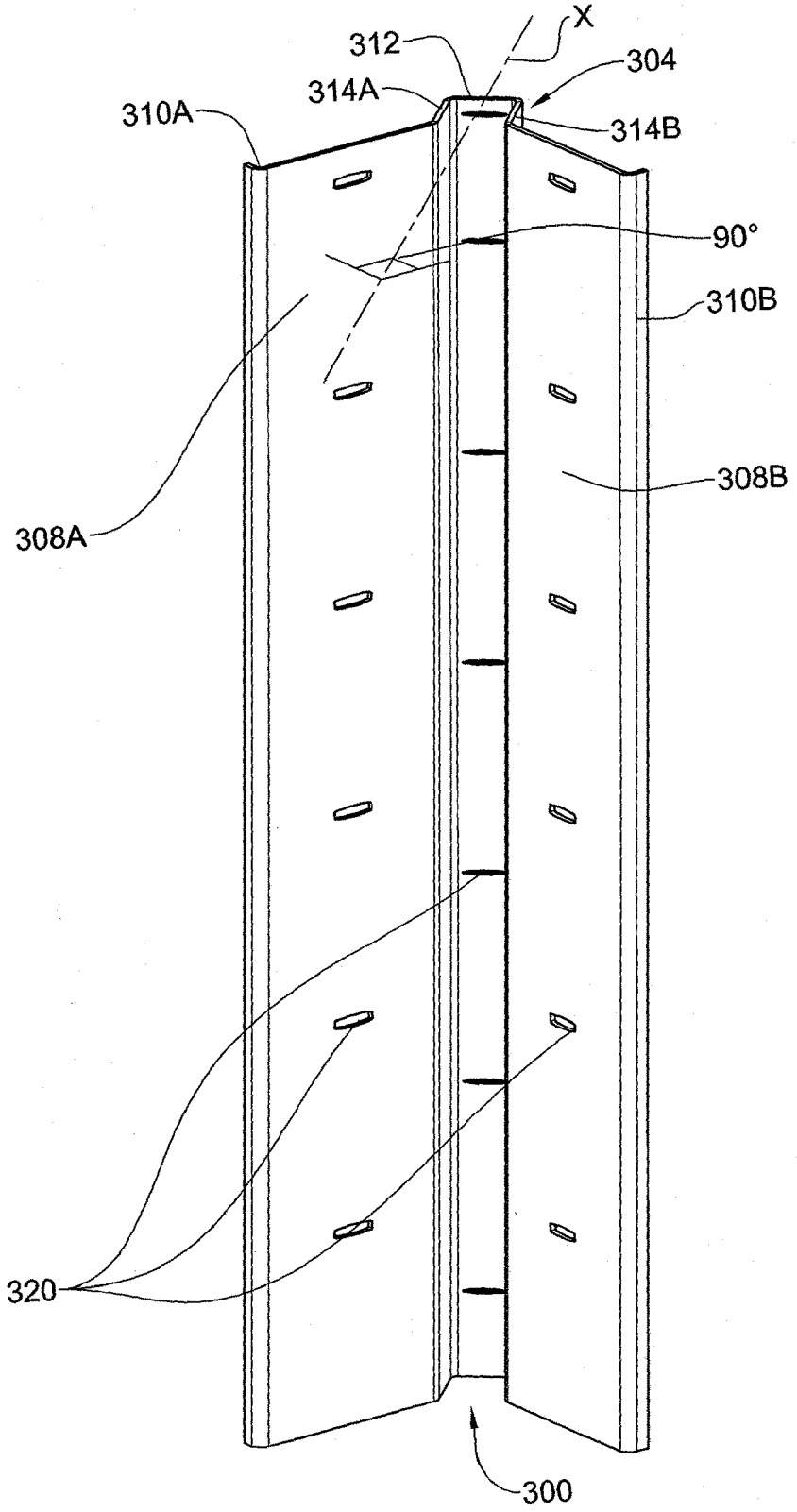
FIG. 12 is a perspective view of the corner coupler seen in FIG. 11.
Figure 13:
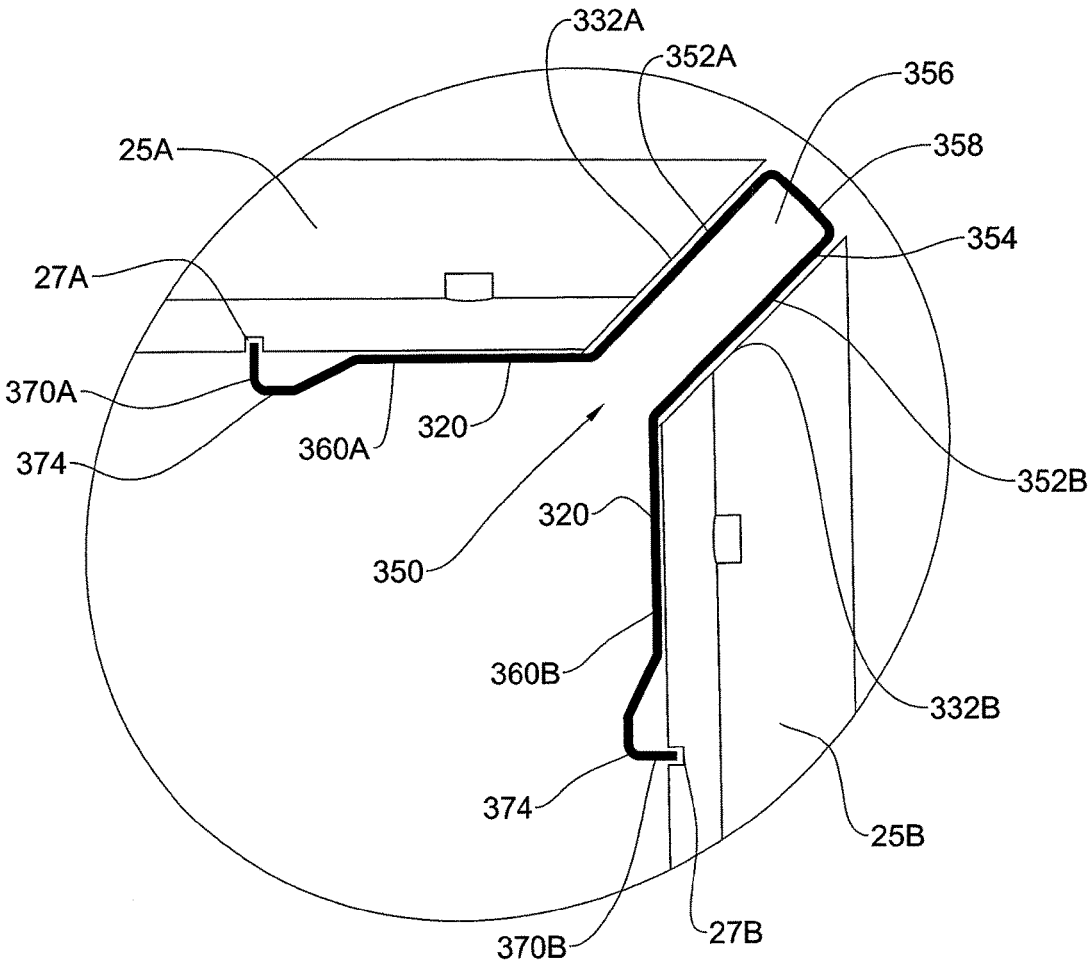
FIG. 13 is a top view illustrating a modification of the corner coupler articulated to wall members.

FIG. 13 illustrates a corner coupler 350 similar to corner coupler 300 disclosed in FIGS. 10 to 12, however with some differences. In the embodiment illustrated in FIG. 13, the side members of the 352A and 352B of the inter-wall gap support 354 extend the full depth of the inter-wall gap 356, such that interconnecting portion 358 extends in-line with the external edges of the chamfered edges 332A and 332B of the wall members 25A and 25B, respectively.

Furthermore, first wall support arm 360A and the second wall support arm 360B are configured for flush bearing against the respective wall members 25A and 25B and securing thereto by screws (not shown) through openings 320. It is seen that the first wall gripping edge 370A and the second wall gripping edge 370B extend at the free ends of the first wall support arm 360A and the second wall support arm 360B, however via an intermediate, inwardly curved portion 374 imparting the wall support arms resiliency for spring biasing into the respective grooves 27A and 27B of the wall members 25A and 25B.

The invention claimed is:

1. An artificial panel, comprising:

a first wall;

a second wall, wherein the first wall and the second wall are spaced apart to define a space, each of the first wall and the second wall having a space-facing surface and an outside surface; and one or more ribs that extend from the first wall to the second wall along at least a portion of the artificial panel, the one or more ribs and the second wall define at least one fastener location with the second wall defining a terminus of the at least one fastener location, the at least one fastener location configured for receiving a fastener therein;

wherein the at least one fastener location is indicated by at least one marking on the first wall corresponding to a location of the one or more ribs;

wherein the one or more ribs are configured to permit the fastener to penetrate the first wall from said outside surface at said at least one fastener location and to be anchored within the one or more ribs and without penetrating the second wall when received within the at least one fastener location.

2. The artificial panel in accordance with claim 1, wherein the first wall and the second wall are of uniform thickness or have a varying thickness.

3. The artificial panel in accordance with claim 1, wherein the first wall and the second wall are parallel to one another.

4. The artificial panel in accordance with claim 1, wherein the one or more ribs are parallel to at least one of the first or the second wall.

5. The artificial panel in accordance with claim 1, wherein the one or more ribs have a central longitudinal axis perpendicular to at least one of the first wall or the second wall.

6. The artificial panel in accordance with claim 1, wherein the one or more ribs extend inclined with respect to at least one of the first wall or the second wall.

7. The artificial panel in accordance with claim 1, wherein the one or more ribs comprise two or more parallel rib portions that extend in close proximity to one another defining a gap therebetween for receiving the fastener.

8. The artificial panel in accordance with claim 7, wherein the gap between the neighboring ribs is sealed by a wall surface, said sealing being configured to be pierced upon introducing a fastener therethrough.

9. The artificial panel in accordance with claim 1, wherein a pre-formed partial bore extends through the rib, the bore being configured for receiving a fastener therethrough.

10. The artificial panel in accordance with claim 9, wherein the pre-formed partial bore is concealed and wherein a fastener location can be marked such that said marking corresponds with the fastener location.

11. The artificial panel in accordance with claim 1, wherein the one or more ribs extend between the two opposite walls and has a substantially conical configuration, the base of the one or more ribs correspond to an entry port of the fastener.

12. The artificial panel in accordance with claim 1, wherein the one or more ribs are conical such that a vertex thereof extends to the space-facing surface of the second wall.

13. The artificial panel in accordance with claim 1, wherein the artificial panel is made of plastic material or composite material comprising a plastic material.

14. An artificial panel, comprising:

a first wall; and a second wall, wherein the first wall and the second wall are spaced apart to define a space, each of the first wall and the second wall having a space-facing surface and an outside surface; and one or more ribs that extend between the first wall and the second wall along at least a portion of the artificial panel to at least partially define at least one fastener location that is a solid body, the at least one fastener location configured for receiving a fastener therein;

wherein the at least one fastener location is indicated by at least one marking on the first wall corresponding to a location of the one or more ribs;

wherein the one or more ribs are configured to permit the fastener to penetrate the first wall from said outside surface at said at least one fastener location and to be anchored within the rib and without penetrating the second wall when received within the at least one fastener location.

15. The artificial panel in accordance with claim 14, wherein the solid body of the at least one fastener location is conically shaped.

16. The artificial panel in accordance with claim 14, wherein the solid body of the at least one fastener location is imperforate.

17. The artificial panel in accordance with claim 14, wherein the one or more ribs and the at least one fastener location are integrally formed with the first wall and the second wall.

18. An artificial panel-fastener assembly, comprising:

an artificial panel including:

a first wall;

a second wall spaced from the first wall to define a space therebetween, each of the first wall and the second wall having a space-facing surface and an outside surface; and one or more ribs that extend between the first wall and the second wall; the one or more ribs and the second wall define at least one fastener location, with the second wall defining a terminus of the at least one fastener location;

wherein the at least one fastener location is indicated by at least one marking on the first wall corresponding to a location of the one or more ribs; and a fastener including a head and a tip, the fastener extends at least partially through the at least one fastener location such that the tip of the fastener is anchored within the one or more ribs without penetrating the second wall.

19. The artificial panel in accordance with claim 1, wherein the at least one marking includes a groove or an indentation.

20. The artificial panel in accordance with claim 14, wherein the at least one marking includes a groove or an indentation.

21. The artificial panel in accordance with claim 18, wherein the at least one marking includes a groove or an indentation.

* * * * *